US007421746B1

(12) United States Patent
Cobi

(10) Patent No.: US 7,421,746 B1
(45) Date of Patent: Sep. 9, 2008

(54) TOILET INSTALLING ASSEMBLY AND METHOD

(76) Inventor: Anold F. Cobi, 5523 N. Long, Chicago, IL (US) 60630

( * ) Notice: Subject to any disclaimer, the term of this patent is extended or adjusted under 35 U.S.C. 154(b) by 432 days.

(21) Appl. No.: 11/181,205

(22) Filed: Jul. 15, 2005

(51) Int. Cl.
*A47K 17/00* (2006.01)

(52) U.S. Cl. ..... 4/661; 254/93 HP

(58) Field of Classification Search ..... 4/661; 254/93 HP
See application file for complete search history.

(56) References Cited

U.S. PATENT DOCUMENTS 4,518,151 A * 5/1985 Dill, Jr. ..... 254/93 HP
4,556,016 A 12/1985 Snell et al.
4,719,685 A * 1/1988 Anderson ..... 254/93 HP X
4,722,511 A 2/1988 Chitwood
5,505,430 A 4/1996 Barnett
5,619,757 A 4/1997 Baratta
D429,592 S 8/2000 Dohan
6,752,379 B1 6/2004 Wall

* cited by examiner

*Primary Examiner*—Robert M Fetsuga

(57) ABSTRACT

A toilet installing assembly includes a bladder that has an upper panel and a lower panel sealed together along peripheral edges of the upper and lower panels. The bladder is selectively inflatable and is substantially planar when not inflated and has a generally rounded shape when the bladder is inflated. An inlet valve is fluidly coupled to the bladder. The bladder is positioned around a toilet drain and then inflated. A toilet is positioned on the bladder. The toilet is aligned with the toilet drain and with a plurality of mounting studs. The bladder is then deflated and the toilet lowered onto the studs.

2 Claims, 6 Drawing Sheets

TOILET INSTALLING ASSEMBLY AND METHOD

BACKGROUND OF THE INVENTION

1. Field of the Invention

The present invention relates to toilet installing devices and more particularly pertains to a new toilet installing device for gradually lowering a toilet onto a toilet drainpipe.

2. Description of the Prior Art

The use of toilet installing devices is known in the prior art. U.S. Pat. No. 4,722,511 describes a wheeled cart device for aiding a person in moving a toilet to be installed. Another type of toilet installing device is U.S. Pat. No. 6,752,379 having a plurality of lifts attached to a frame that may be secured to a toilet for selectively lifting or lowering a toilet. Yet another such device is found in U.S. Pat. No. 5,505,430, which again includes a device used for supporting a toilet off of a floor surface during the installation process of the toilet.

While these devices fulfill their respective, particular objectives and requirements, the need remains for a device that may be used for selectively lifting or lowering a toilet during its installation. Additionally, the device should be easily storable and transportable when not in use. In particular, the device should be foldable for easy storage in a toolbox or the like.

SUMMARY OF THE INVENTION

The present invention meets the needs presented above by generally comprising a bladder that includes an upper panel and a lower panel sealed together along peripheral edges of the upper and lower panels. The bladder is selectively inflatable and is substantially planar when not inflated and has a generally rounded shape when the bladder is inflated. An inlet valve is fluidly coupled to the bladder. The bladder is positioned around a toilet drain and then inflated. A toilet is positioned on the bladder. The toilet is aligned with the toilet drain and with a plurality of mounting studs. The bladder is then deflated and the toilet lowered onto the studs.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
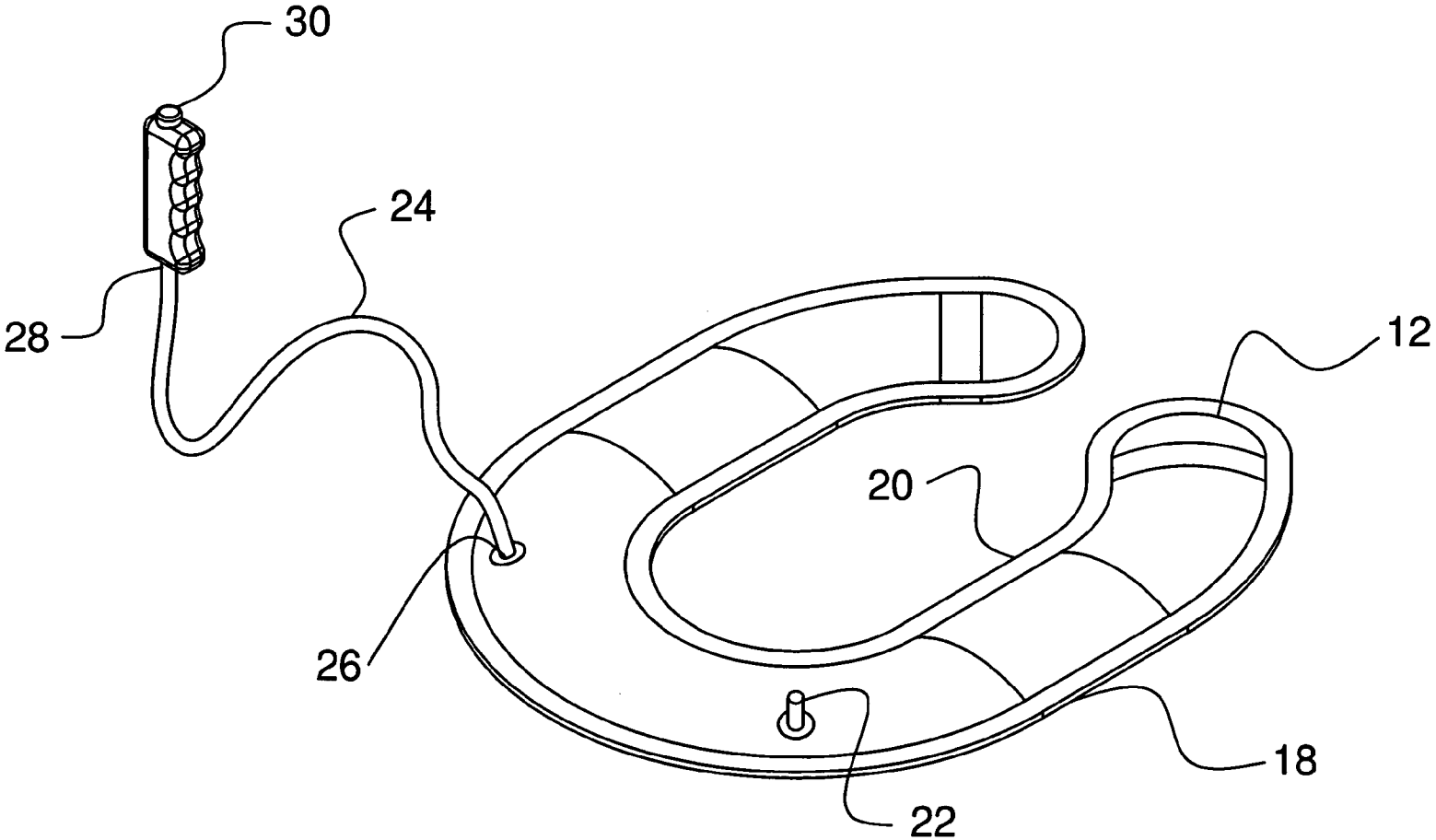
FIG. 1 is a perspective view of a toilet installing assembly and method according to the present invention.
Figure 2:
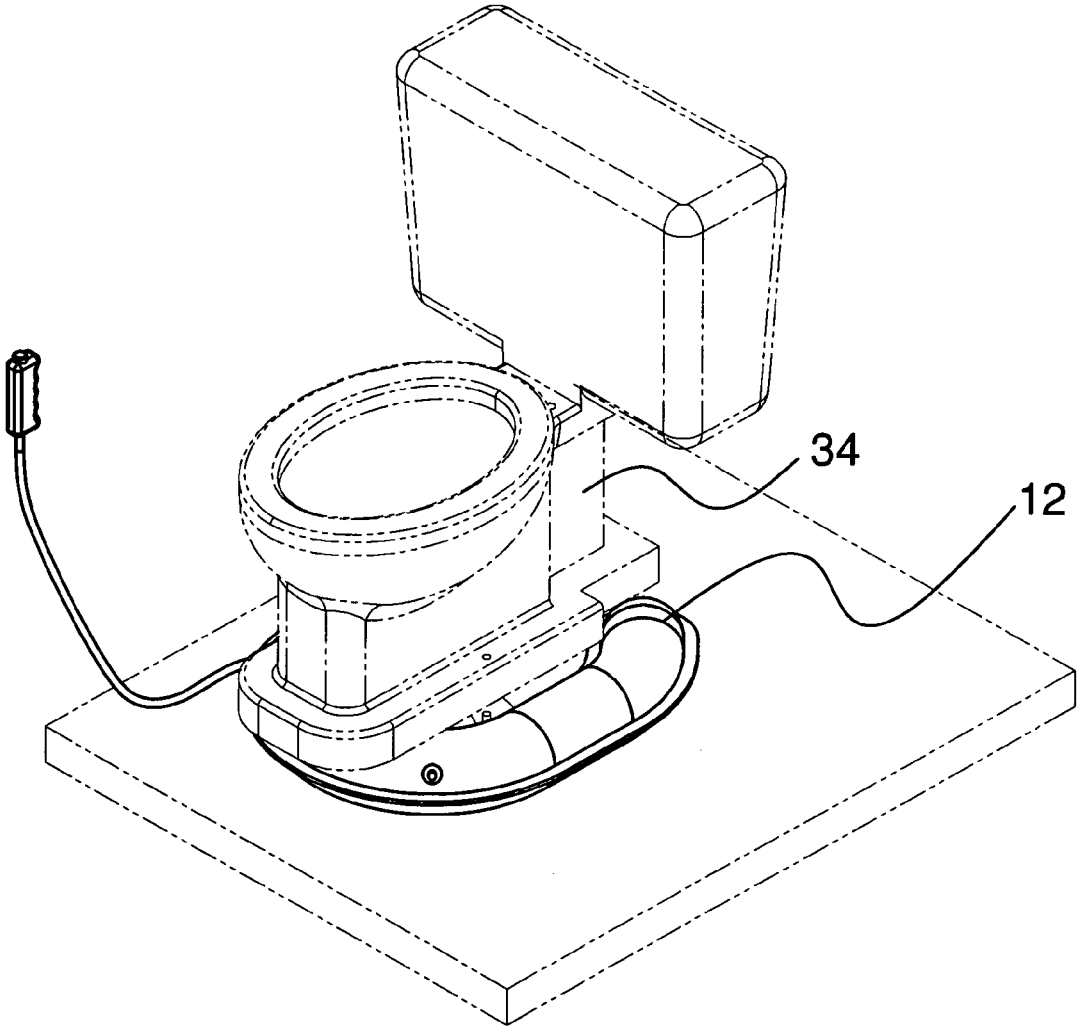
FIG. 2 is a perspective in-use view of the present invention.
Figure 3:
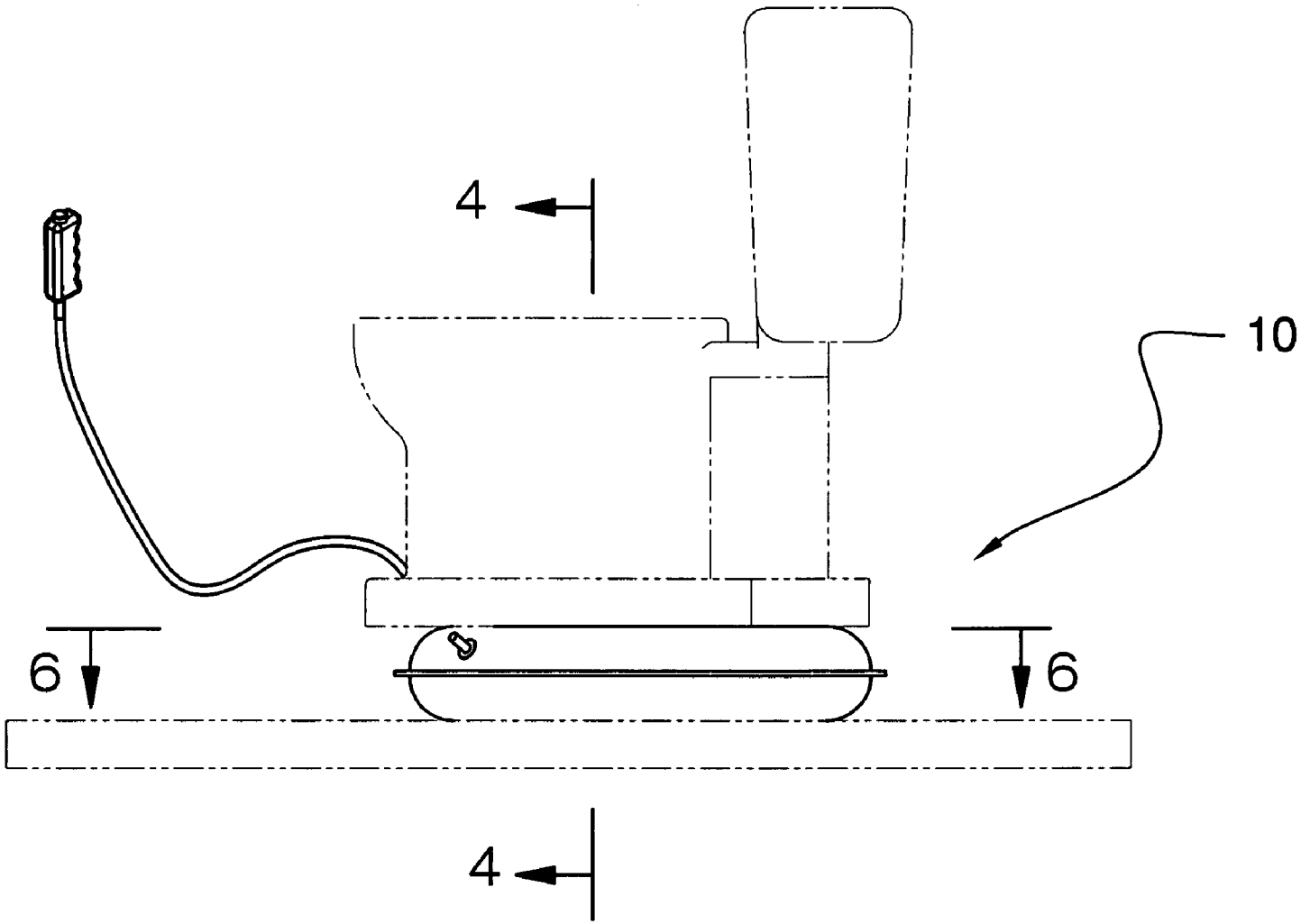
FIG. 3 is a side view of the present invention.
Figure 4:
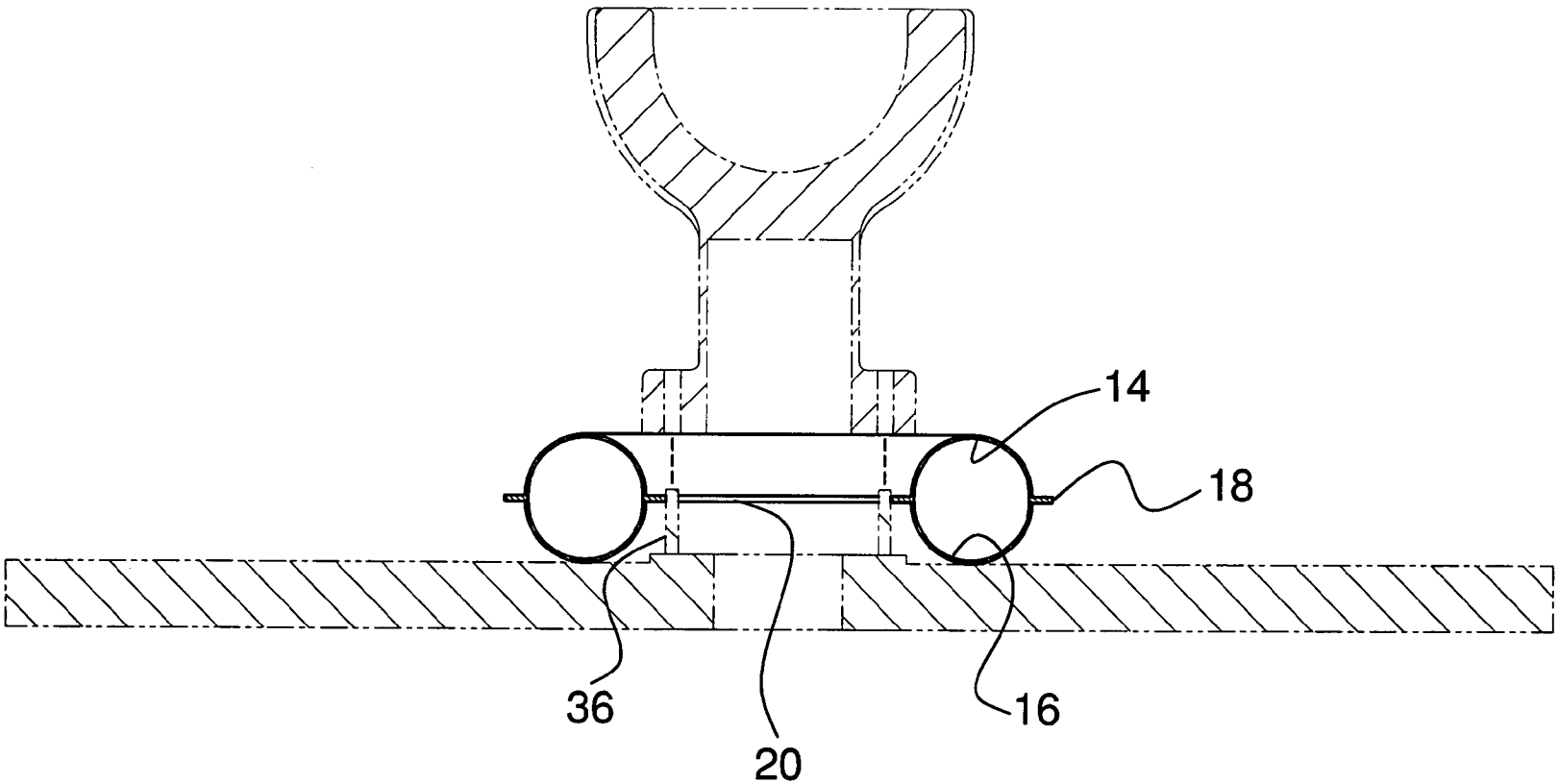
FIG. 4 is a cross-sectional view taken along line 4-4 of FIG. 3 of the present invention.
Figure 5:
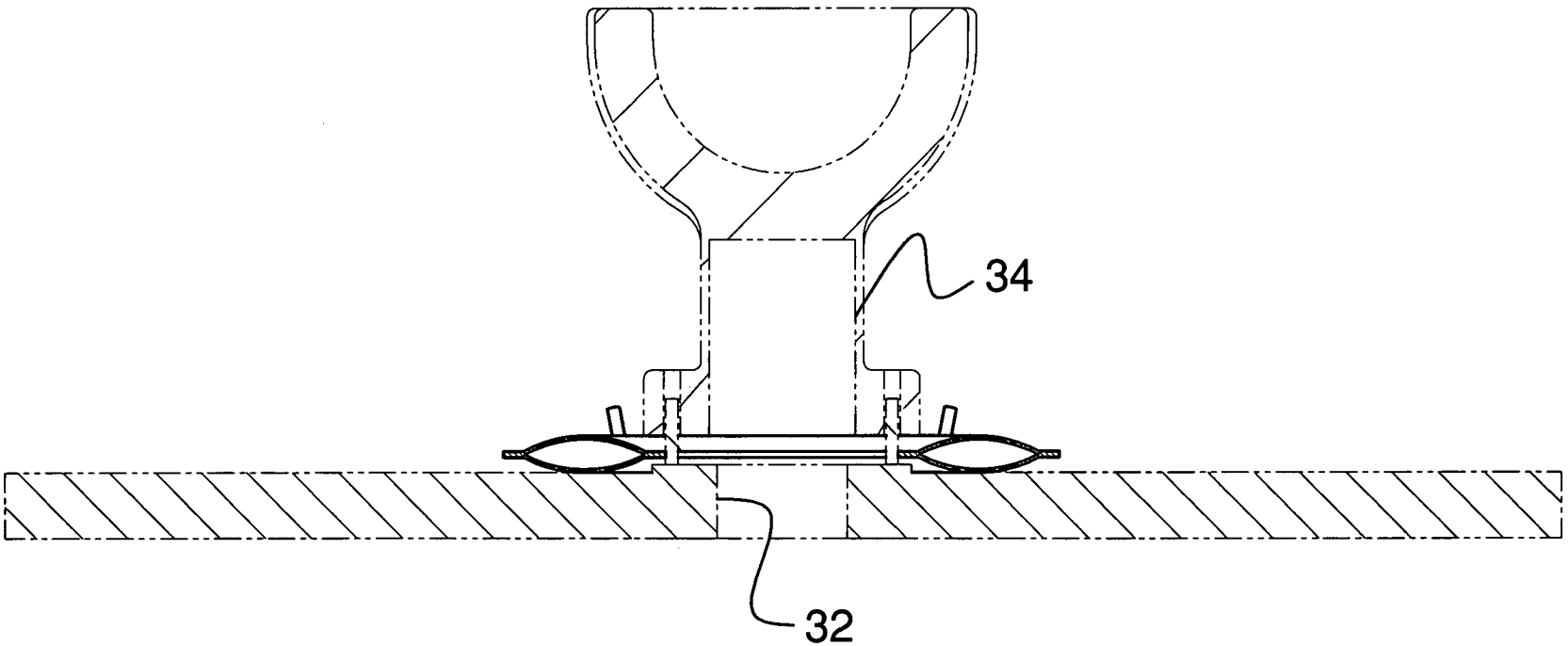
FIG. 5 is a cross-sectional view of the present invention in a deflated position.
Figure 6:
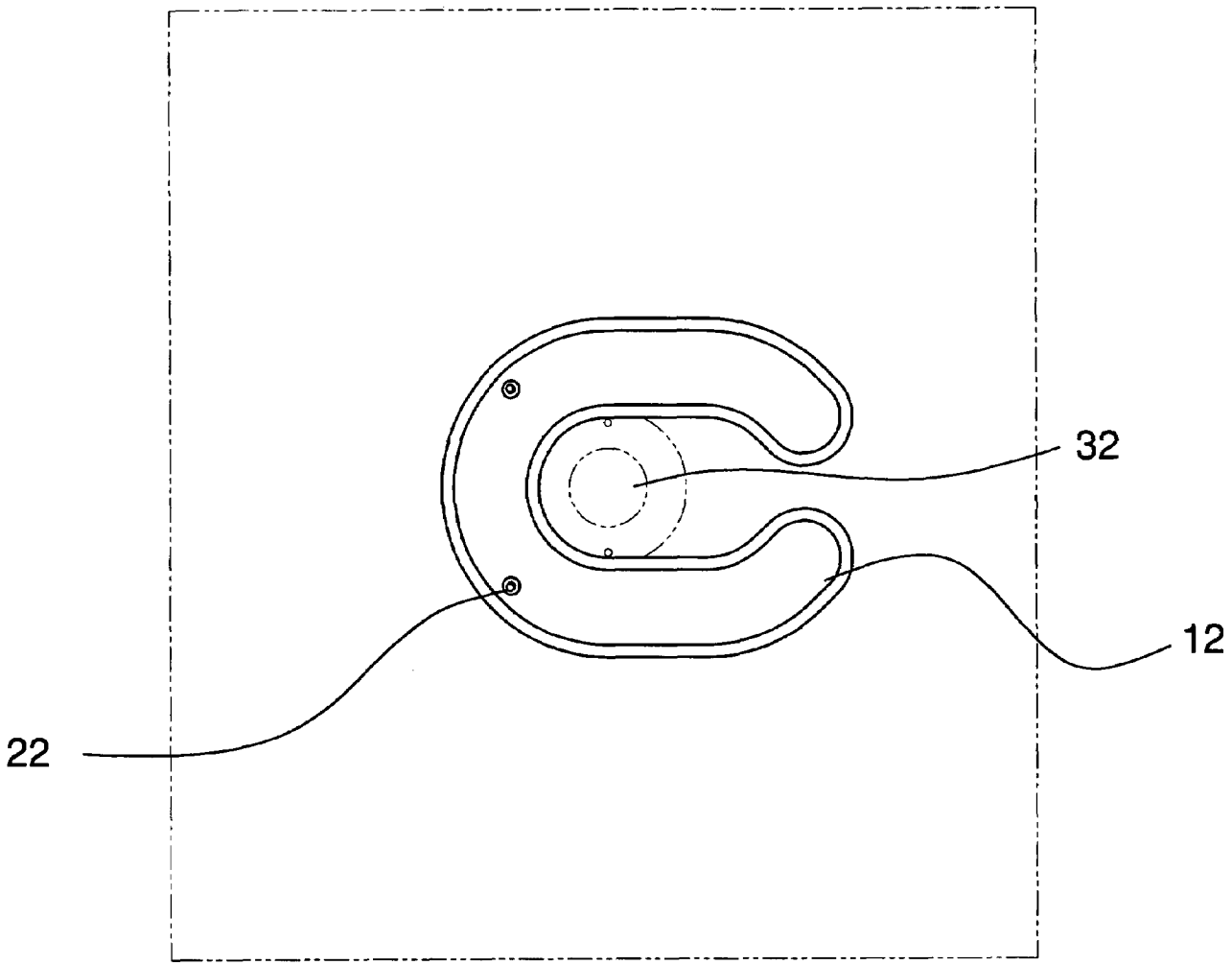
FIG. 6 is a top view of the present invention.

With reference now to the drawings, and in particular to FIGS. 1 through 6 thereof, a new toilet installing device embodying the principles and concepts of the present invention and generally designated by the reference numeral 10 will be described.

As best illustrated in FIGS. 1 through 6, the toilet installing assembly and method 10 generally comprises a bladder 12. The bladder 12 includes an upper panel 14 and a lower panel 16 sealed together. The bladder 12 is selectively inflatable. The bladder 12 is substantially planar when not inflated and has a generally rounded cross-sectional shape when the bladder is inflated. The bladder 12 is U-shaped and has an outer peripheral edge 18 and an inner peripheral edge 20.

An inlet valve 22 is fluidly coupled to the bladder 2. The inlet valve 22 is a one-way valve configured to allow air into the bladder 12. A tube 24 has a first end 26 and a second end 28. The first end 24 is fluidly coupled to the bladder 12. A release valve 30 is fluidly coupled to the second end 28 of tube 24 and is configured to release pressurized air positioned in the bladder 12. The inlet 22 and the release 30 valves are conventional valves.

In use, the bladder 12 is positioned around a toilet drain 32 and the bladder 12 is inflated. A toilet 34 is positioned on the bladder 12 and the toilet 34 is aligned with the toilet drain 32 and with a plurality of mounting studs 36. The bladder 12 is then deflated and the toilet 34 lowered onto the studs 36. The bladder 12 is then slid out from under the toilet 34 and the toilet 34 secured in place.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of installing a toilet comprising the steps of:

positioning a bladder around a toilet drain, said bladder including an upper panel and a lower panel sealed together along peripheral edges of said upper and lower panels, said bladder being selectively inflatable, said bladder being substantially planar when not inflated and having a generally rounded shape when said bladder is inflated, said bladder being U-shaped and has an outer peripheral edge and an inner peripheral edge, an inlet valve being fluidly coupled to said bladder;

inflating said bladder;

positioning a toilet on said bladder;

aligning said toilet with the toilet drain and with a plurality of mounting studs; and deflating said bladder and lowering said toilet onto said studs.

2. A method of installing a toilet comprising the steps of:

positioning a bladder around a toilet drain, said bladder including an upper panel and a lower panel sealed together along peripheral edges of said upper and lower panels, said bladder being selectively inflatable, said bladder being substantially planar when not inflated and having a generally rounded shape when said bladder is inflated, said bladder being U-shaped and having an outer peripheral edge and an inner peripheral edge, said bladder including an inlet valve being fluidly coupled to said bladder, said inlet valve being a one-way vale configured to allow air into said bladder;

inflating said bladder;

positioning a toilet on said bladder;

aligning said toilet with the toilet drain and with a plurality of mounting studs; and deflating said bladder and lowering said toilet onto said studs, a tube having a first end and a second end, said first end being fluidly coupled to said bladder, a release valve being fluidly coupled to said second end of said tube and being configured to release pressurized air from said bladder.

* * * * *